US006500061B1

(12) United States Patent
Ambrose

(10) Patent No.: US 6,500,061 B1
(45) Date of Patent: Dec. 31, 2002

(54) TILTING HOOD VENTILATOR

(76) Inventor: Wallace Raymond Ambrose, 47 Couvreur Street, Garran ACT 2605 (AU)

( * ) Notice: Subject to any disclaimer, the term of this patent is extended or adjusted under 35 U.S.C. 154(b) by 0 days.

(21) Appl. No.: 10/131,427

(22) Filed: Apr. 24, 2002

(30) Foreign Application Priority Data

Oct. 12, 2001 (AU) ..... 8216

(51) Int. Cl.[7] ..... F23L 17/04
(52) U.S. Cl. ..... 454/9; 52/198; 454/11
(58) Field of Search ..... 454/20, 15, 9, 454/5; 52/198, 199

(56) References Cited

U.S. PATENT DOCUMENTS

| | | | | | |
|---|---|---|---|---|---|
| 109,081 | A | * | 11/1870 | Van Deventer | 126/302 |
| 832,188 | A | * | 10/1906 | Hall | 454/5 |
| 1,420,141 | A | * | 6/1922 | Pennington | 454/20 |
| 1,533,344 | A | | 4/1925 | Singleton | |
| 1,638,738 | A | * | 8/1927 | Lichty et al. | 454/30 |
| 2,214,183 | A | | 9/1940 | Seymour | |
| 2,529,491 | A | | 11/1950 | Gadzuk | |
| 2,601,423 | A | | 6/1952 | Allman et al. | |
| 2,875,678 | A | * | 3/1959 | Shepherd | 454/355 |
| 2,923,225 | A | | 2/1960 | Massey | |
| 3,742,659 | A | * | 7/1973 | Drew | 285/44 |
| 3,942,422 | A | | 3/1976 | Kawai et al. | |
| 4,287,816 | A | | 9/1981 | Riccard | |
| 4,535,715 | A | | 8/1985 | McIntosh | |
| 4,593,610 | A | | 6/1986 | Chabot | |
| 4,671,171 | A | * | 6/1987 | Brill | 454/2 |
| 4,989,503 | A | * | 2/1991 | Shank | 454/25 |
| 5,248,278 | A | | 9/1993 | Fuerst et al. | |
| 5,498,205 | A | | 3/1996 | Knowles et al. | |
| 5,766,071 | A | | 6/1998 | Kirkwood | |

* cited by examiner

*Primary Examiner*—Derek Boles
(74) *Attorney, Agent, or Firm*—Frommer Lawrence & Haug, LLP; Ronald R. Santucci

(57) ABSTRACT

A roof ventilator comprises a duct 1 having a symmetrical hood 3 supported at its apex 4 by bearing 10. In the absence of wind, hood 3 is spaced from the upper end 2 of duct 1 with its depending skirt 6 surrounding upper end 2 However, wind from any direction causes the hood to tilt so that skirt 6 is lowered on the windward side thus increasing the ventilation rate and thus positioning hood 3 to deflect wind and wind-borne material from the ventilator opening.

4 Claims, 2 Drawing Sheets

TILTING HOOD VENTILATOR

FIELD OF INVENTION

The invention relates to ventilation to control temperature, humidity and air quality in confined spaces. Ventilation of confined spaces involves movement of fresh air thereto and removal of vitiated air therefrom. A confined space to which the invention applies may be a room or an attic in a domestic building, an area in a farm building for storing produce or accommodating animals, a workspace in an industrial establishment, in an underground formation such as a mine or tunnel or in a road, rail or water vehicle. The air in such confined spaces may be spoiled because of depletion of the oxygen content of the air and/or due to the presence of odours, noxious gases, smoke, dust and the like.

BACKGROUND OF INVENTION

Ventilation apparatus for this purpose is well known and many systems such as powered, wind-assisted and convective arrangement have been proposed. To achieve effective circulation of air, the inlet for fresh air has generally been located at a lower level than the outlet for spoiled air which has usually been at ceiling or roof level. Commonly, the outlet has been a roof ventilator comprising a substantially vertical shaft or duct passing through the roof of the structure enclosing the confined space or mounted adjacent to the roof As the open top end of the duct is exposed to atmosphere, it has usually been provided with a cap or canopy which does not impede the outflow of air from the duct but provides some protection from atmospheric deposits such as rain and snow entering the duct and passing to the confined space. However, wind-borne dust, rain, spray and snow can still pass under the cap and into the duct and pass to the confined space, even when some wind-assisted devices such as turbine ventilators are installed.

DESCRIPTION OF PRIOR ART

There have been some prior proposals intended to avoid wind driven rain and other material entering the ventilating opening in the roof of a structure. There are also some prior wind directed devices for ventilators and chimneys.

In U.S. Pat. No. 4,989,503 (Shank), there is disclosed a wind-directed roof ventilator comprising a hood covering an elongated opening in the roof of a farm building. The hood is pivotally mounted and is capable of side-to-side movement to two oppositely located limit positions by means of a drive motor controlled by a wind-directed-responsive vane mechanism. In the event of particular wind directions, the position of the hood is varied to minimize the risk of wind-driven rain from entering the ventilating opening.

U.S. Pat. No. 1,420,141 (Pennington) discloses a flue hood for preventing back draft and the entry of rain to the flue. A V-shaped hood is pivotally mounted above the flue opening and is adapted to oscillate about a horizontal axis to cover and uncover opposite sides of the flue. Wind pressure actuated means causes the hood to tilt to cover the side of the flue to windward.

U.S. Pat. No. 4,593,610 (Chabot) discloses a wind directed automatic damper for a chimney flue designed to keep constant the chimney draft despite varying wind velocity and direction.

U.S. Pat. No. 2,601,423 (Allman et al) discloses a roof ventilator for exhausting air from a building. The ventilator has a cap and baffles intended to prevent wind or wind driven rain or snow from entering the building through the ventilator and a movable damper blade to control exhaustion of air from the building.

U.S. Pat. No. 5,498,205 (Knowles et al) discloses a roof ventilator having exhaust ports in opposite vertical sides and deflecting baffles to allow air and fumes from the interior of the building to be exhausted generally horizontally while preventing wind driven rain, snow and like from entering the building through the ventilator. An air control baffle is provided to control the exhaust.

U.S. Pat. No 2,923,225 (Massey) discloses a roof ventilator for a building. The ventilator is of generally rectangular cross-section and has downwardly facing exhaust ports in opposite sides and a damper blade for controlling the flow of air from the building.

U.S. Pat. No. 2,214,183 (Seymour) discloses a roof ventilator, extending along a roof ridge, with curved baffles forming downwardly facing exhaust ports on opposite sides of the ridge.

DESCRIPTION OF THE INVENTION

It is an object of the invention to provide a roof ventilator having a tilting hood which is designed to operate as a combined wind assisted and convective ventilator that avoids the ingress of wind and wind-borne material.

The roof ventilator of the invention is simple in operation in that it requires the hood of the ventilator to be mounted on a single pivot bearing allowing the hood to tilt away from the wind thus increasing the ventilation rate due to the suction caused by wind flowing around the hood and thus positioning the hood to deflect wind and wind-borne material from the ventilator opening irrespective of wind direction. The invention provides a tilting hood ventilator which is simple in construction with few moving parts.

In accordance with the invention, a ventilator for a structure enclosing a confined space comprises a duct adapted to be mounted in a substantially upright position having an open upper end exposed to the atmosphere and a lower end communicating with the confined space, a substantially symmetrical hood having a base located substantially at the apex of the hood and a skirt fixed to the base and depending therefrom, a socket in the base opening on the underside thereof, a rigid support having a lower end connected to said duct and an upper end, a bearing fixed to the upper end of the support and seated in the socket so that the base of the hood is supported in a position spaced above the upper end of the duct with the depending skirt surrounding the upper end of the duct, the arrangement being such that, in the absence of wind, the hood is spaced from the duct and, in the presence of wind from any direction, the hood is tilted by the wind so that the skirt is lowered on the windward side thus increasing the ventilation rate and thus positioning the hood to deflect wind and wind-borne material from the ventilator opening.

The rigid support may be fixed to the ventilator duct. Alternatively, the support may be mounted so that it can raise or lower the hood to open or close the ventilator duct.

DESCRIPTION OF THE EMBODIMENTS

Figure 1:
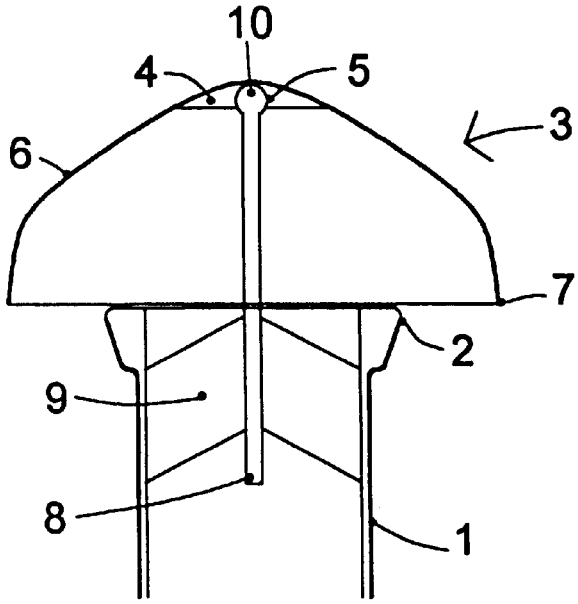
FIG. 1 is a sectional view illustrating one embodiment of tilting hood roof ventilator in accordance with the invention with the hood shown in an untilted position.

FIG. 1 illustrates one form of roof ventilator in accordance with the invention. The ventilator comprises a duct 1 adapted to be mounted in a substantially vertical or upright position to pass through the roof (not shown) of a structure enclosing a confined space in need of ventilation. Duct 1 is preferably provided with an enlarged, preferably tapered, outer upper end 2. Upper end 2 may be formed by outward flaring or thickening the end of the wall of duct 1. Alternatively, a collar may be fixed to duct 1 in any convenient manner, for example by being slipped over the end of duct 1 and held thereon by friction or adhesive. The open upper end of duct 1 is exposed to the atmosphere The lower end of duct 1 communicates either directly or indirectly with the confined space. Thus vitiated air may pass by convection from the confined space through ventilator duct 1 to the atmosphere.

The roof ventilator comprises a hood which is generally indicated by the reference 3. The hood 3 is substantially symmetrical being umbrella shaped or the shape of an inverted basin. At its apex, hood 3 includes a base 4 which has a substantially spherical socket 5 opening on the underside of base 4. Hood 3 also includes a skirt 6 depending from base 4 and fixed thereto in any convenient manner. From base 4, skirt 6 flares outwardly and downwardly to rim 7 which surrounds and, in the absence of wind, is normally spaced from upper end 2 of duct 1. The shape of hood 3 is not critical. It must be sufficiently large to prevent atmospheric deposits from entering duct 1 and be spaced sufficiently from upper end 2 so not to impede vitiated air passing from the confined space to atmosphere. Hood 3 may be made of any suitable material such as metal or plastics material, for example by stamping, die-casting or spinning. However, hood 3 must be sufficiently strong to withstand expected atmospheric conditions such as rain, snow, wind and wind entrained material. In the hood thus described, socket 5 is located at or near the centre of gravity of hood 3.

Figure 3:
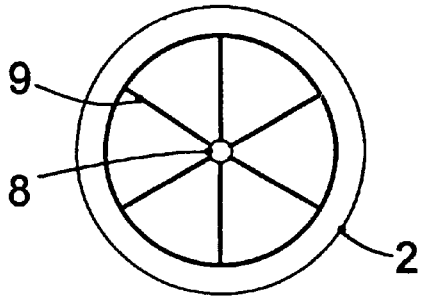
FIG. 3 is a plan view of the ventilator duct.
Figure 6:
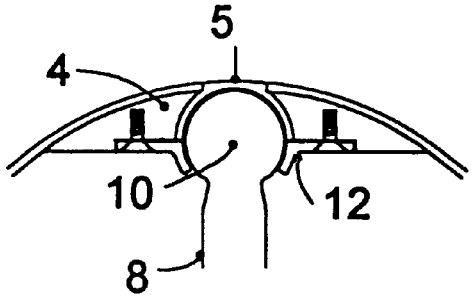
FIG. 6 is a sectional view illustrating details of a socket and bearing suitable for supporting the hood.

Hood 3 is mounted at the end of a rigid vertical support 8 which, as shown in FIG. 3, is attached firmly to the inner surface of duct 1 by a series of spokes or, preferably, blades 9 which offer the least resistance to air flow through duct 1. Fixed at the top end of vertical support 8 is a substantially spherical bearing 10 that is seated within substantially spherical socket 5 to permit limited relative movement in any direction between bearing 10 and socket 5. Details of this type of socket and bearing are illustrated in FIG. 6. The construction is such that bearing 10 is permanently retained in socket 5 to avoid accidental separation of hood 3 from its vertical support 8. However, base 4 has a removable collar 12 to allow removal of bearing 10 from socket 5 in appropriate circumstances.

Figure 2:
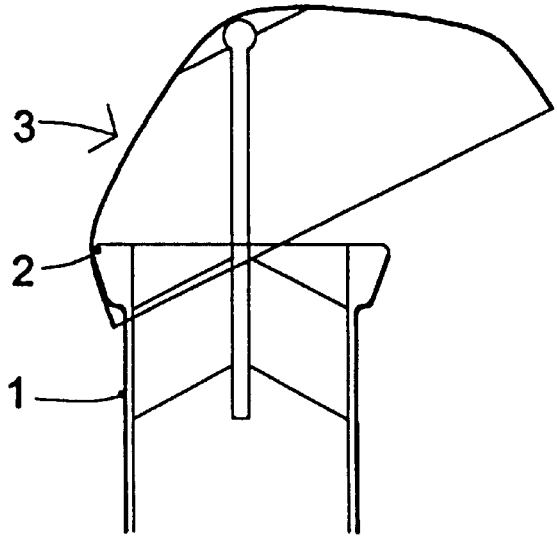
FIG. 2 is a view similar to FIG. 1 with the hood shown in a tilted position.

In use, with no wind effect, hood 3 remains in its normal resting position with rim 7 located in a substantially horizontal plane surrounding and spaced from the upper end 2 of duct 1 as shown in FIG. 1. In these circumstances, the ventilator operates simply as a duct between the confined space and the atmosphere while excluding any vertically falling deposits such as rain, snow or dust from entering the duct 1. However, wind pressure from any direction on suspended hood 3 causes it to tilt so that the skirt is lowered on the windward side thereby increasing the ventilation rate and thus positioning the hood to deflect any wind-borne material away from the duct opening. Wind deflection of hood 3 is limited by contact of hood 3 with upper end 2 as shown in FIG. 2. The enlarged upper end 2 assists in diverting wind-borne matter from the duct opening when the hood is at its maximum tilt with hood 3 contacting upper end 2. Preferably, upper end 2 is treated to avoid noise due to contact with hood 3 in variable wind conditions. In the case of a sleeve fitted around the upper end of duct 1, it may be made of rubber or the like. A change in wind direction causes a corresponding change in the direction of tilt of hood 3.

Figure 4:
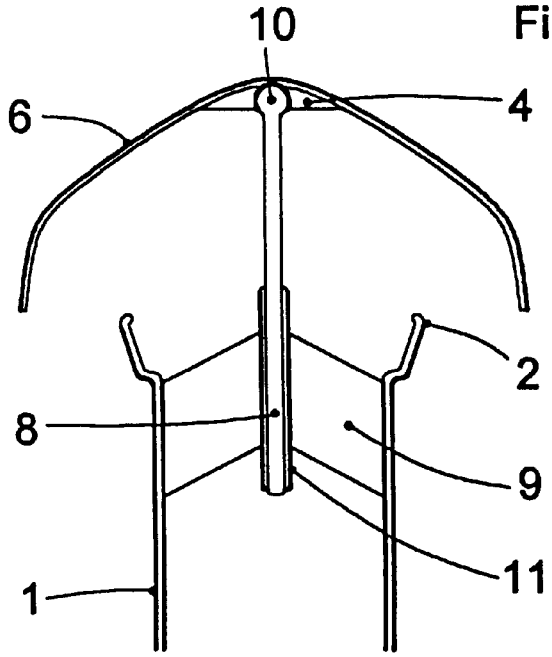
FIG. 4 is a sectional view illustrating a second embodiment showing the hood spaced above the ventilator duct.
Figure 5:
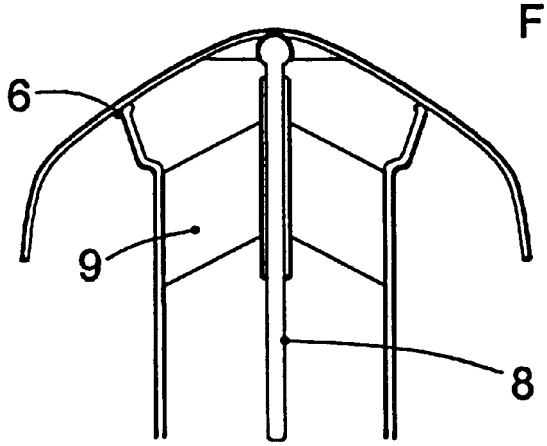
FIG. 5 is a view similar to FIG. 4 with the hood closing the ventilator duct.

In the embodiment illustrated in FIGS. 4 and 5, the tilting hood can be drawn down to partly or fully close ventilation duct 1 to prevent heat loss in winter or exclude unwanted air-borne material in the event of very high velocity winds or other extreme conditions. To this end, rigid support 8 is held at the centre of duct 1 by a sleeve 11 that is fixed to the duct wall by a plurality of radial blades 9. Rigid support 8 is capable of vertical sliding movement in sleeve 11 to close ventilating duct 1 by bringing hood 3 to seat on upper end 2 as illustrated in FIG. 5. Rigid support 8 may be raised to open duct 1. When raised to an open position, the hood is tilted by wind from any direction as described in relation to FIGS., 1 to 3. Opening and closing the ventilator may be by any suitable means such as mechanical means or electromechanical means which could be remote controlled. Those means may include holding the shaft at its closed and one or more open positions.

Other modifications would be obvious to those skilled in the art. For example, other types of bearing and socket may be used to allow the hood to move as described above.

I claim:

1. A ventilator for a structure enclosing a confined space, said ventilator comprising a duct adapted to be mounted in a substantially upright position having an open upper end exposed to the atmosphere and a lower end communicating with the confined space, a substantially symmetrical hood having a base located substantially at the apex of the hood and a skirt fixed to the base and depending therefrom, a socket in the base opening on the under side thereof, a rigid support having a lower end connected to said duct and an upper end, a bearing fixed to the upper end of the support and seated in the socket so that the base of the hood is supported in a position spaced above the upper end of the duct with the depending skirt surrounding the upper end of the duct, the arrangement being such that, in the absence of wind, the hood is spaced from the duct and, in the presence of wind from any direction, the hood is tilted by the wind so that the skirt is lowered on the windward side thus increasing the ventilation rate and thus positioning the hood to deflect wind and wind-borne material from the ventilator opening.

2. A ventilator as claimed in claim 1, wherein the bearing is substantially spherical and is seated in a substantially spherical socket.

3. A ventilator as claimed in claim 1, wherein the rigid support is firmly attached to the inner surface of the duct.

4. A ventilator as claimed in claim 1, wherein the rigid support is mounted within the duct so as to be capable of substantially vertical movement so that the hood may be lowered onto the upper end of the duct to close the ventilator duct.

* * * * *